US007590375B2

(12) United States Patent
Iwata

(10) Patent No.: US 7,590,375 B2
(45) Date of Patent: Sep. 15, 2009

(54) IMAGE-FORMING APPARATUS HAVING MOVABLE TENSIONER AND ELECTRODE MEMBER THAT REDUCE TONER SCATTER

(75) Inventor: Hyoe Iwata, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 463 days.

(21) Appl. No.: 11/469,212

(22) Filed: Aug. 31, 2006

(65) Prior Publication Data

US 2007/0059055 A1 Mar. 15, 2007

(30) Foreign Application Priority Data

Sep. 13, 2005 (JP) ..... 2005-265525

(51) Int. Cl.
*G03G 15/01* (2006.01)

(52) U.S. Cl. ..... 399/302

(58) Field of Classification Search ..... 399/165, 399/298, 299, 302

See application file for complete search history.

(56) References Cited

U.S. PATENT DOCUMENTS 6,477,349 B2 * 11/2002 Kanekura et al. ..... 399/302
6,606,475 B1 * 8/2003 Maier et al. ..... 399/302
6,731,895 B2 * 5/2004 Hamada et al. ..... 399/165
7,308,225 B2 * 12/2007 Kaiho ..... 399/302

FOREIGN PATENT DOCUMENTS

JP 11-143255 5/1999
JP 2004-109743 4/2004

* cited by examiner

*Primary Examiner*—William J Royer
(74) *Attorney, Agent, or Firm*—Canon USA Inc IP Div

(57) ABSTRACT

An image-forming apparatus includes an image-carrying belt that is rotated while carrying toner images on an outer circumferential surface thereof; a movable tensioner applying tension to the image-carrying belt, a position of the tensioner being changed while being in contact with the inner circumferential surface of the image-carrying belt, the tensioner being electrically grounded or a voltage being applied to the tensioner; and an electrode member, a position of the electrode member being changed in conjunction with a change of the position of the tensioner so as to maintain a predetermined distance from the image-carrying belt, the electrode member being electrically grounded or a voltage being applied to the electrode member.

3 Claims, 11 Drawing Sheets

IMAGE-FORMING APPARATUS HAVING MOVABLE TENSIONER AND ELECTRODE MEMBER THAT REDUCE TONER SCATTER

BACKGROUND OF THE INVENTION

1. Field of the Invention

The present invention relates to image-forming apparatuses of an electrophotographic type using intermediate transfer bodies, and in particular, relates to image-forming apparatuses capable of reducing degradation of toner images on intermediate transfer bodies.

2. Description of the Related Art

Recently, intermediate transfer belts (image-carrying belts) have been often used for forming images on various recording media in image-forming apparatuses that form images using electrophotography.

However, when toner images that are transferred onto the intermediate transfer belts reach supporting rollers that support the intermediate transfer belts, the toner on the intermediate transfer belts scatters.

According to Japanese Patent Laid-Open No. 2004-109743, electrode plates to which a predetermined voltage is applied are disposed in the vicinity of a supporting roller such that a desired electric field is generated between the electrode plates and an intermediate transfer belt. Thus, the scattering of the toner on the intermediate transfer belt is regulated by the action of the electric field.

However, when a movable tensioner that is in contact with the image-carrying belt and applies a predetermined tension to the image-carrying belt is provided, the path taken by the image-carrying belt is changed.

The positional relationship between the image-carrying belt and the electrode plates is changed as the path of the image-carrying belt is changed, and as a result, a desired electric field cannot be formed between the image-carrying belt and the electrode plates.

Thus, the scattering of the toner cannot be regulated.

SUMMARY OF THE INVENTION

The present invention is directed to an image-forming apparatus capable of reducing toner scattering even when the path taken by an image-carrying belt is changed according to the movement of a tensioner.

According to one aspect of the present invention, an image-forming apparatus includes an image-carrying belt that is rotated while carrying toner images on an outer circumferential surface thereof; a movable tensioner applying tension to the image-carrying belt, a position of the tensioner being changed while being in contact with the inner circumferential surface of the image-carrying belt, the tensioner being electrically grounded or a voltage being applied to the tensioner; and an electrode member, a position of the electrode member being changed in conjunction with a change of the position of the tensioner so as to maintain a predetermined distance from the image-carrying belt, the electrode member being electrically grounded or a voltage being applied to the electrode member.

According to another aspect of the present invention, an image-forming apparatus includes an image-carrying belt that is rotated while carrying toner images on an outer circumferential surface thereof; a movable tensioner applying tension to the image-carrying belt, a position of the tensioner being changed while being in contact with the inner circumferential surface of the image-carrying belt, the tensioner being electrically grounded or a voltage being applied to the tensioner; a movable electrode member, the electrode member being electrically grounded or a voltage being applied to the electrode member; and a connecting member connecting the tensioner and the electrode member, and wherein the electrode member is moved in conjunction with movement of the tensioner by the connecting member.

Further features of the present invention will become apparent from the following description of exemplary embodiments (with reference to the attached drawings).

DESCRIPTION OF THE EMBODIMENTS

According to the present invention, an electrode member is moved in response to the movement of a tensioner such that occurrence of toner scattering is reduced.

That is, a predetermined positional relationship between the tensioner and the electrode member is maintained such that a desired electric field is formed between an image-carrying belt and the electrode member even when the path of the image-carrying belt is changed according to the movement of the tensioner.

In this manner, scattering of toner on an image carrier can be regulated.

Exemplary embodiments of the present invention will now be described in detail with reference to the drawings.

First Exemplary Embodiment

Figure 1:
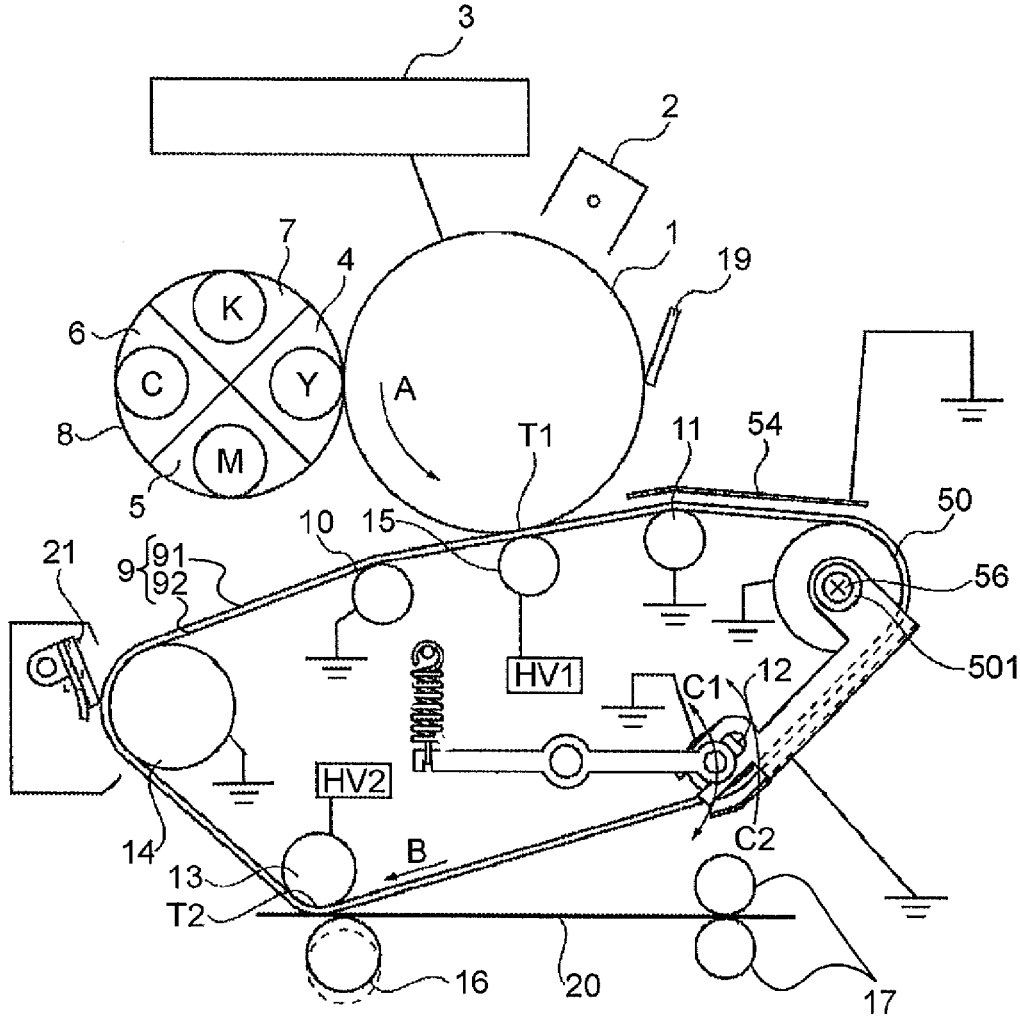
FIG. 1 is a cross-sectional view illustrating a first exemplary embodiment.

FIG. 1 illustrates a schematic structure of a color-image-forming apparatus to which the present invention is applied.

Figure 2:
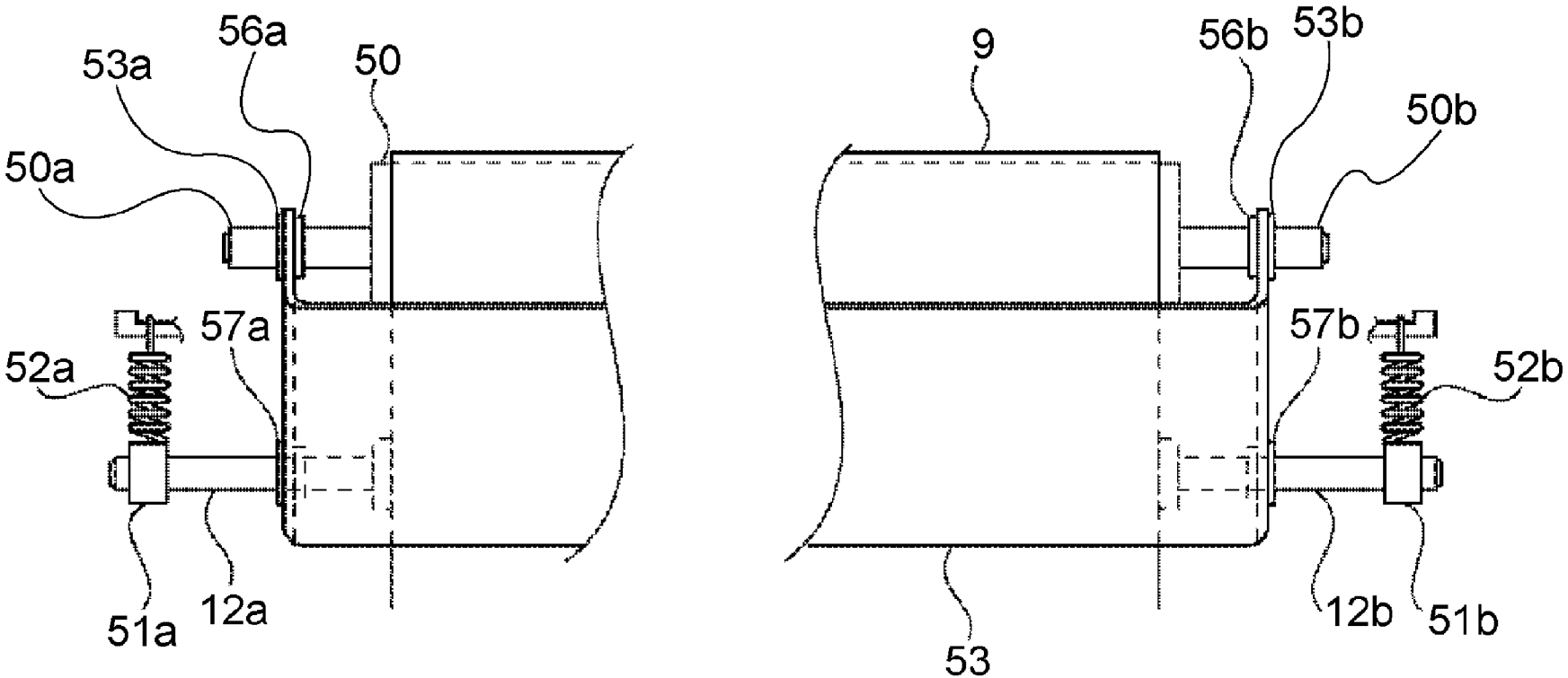
FIG. 2 is a side view illustrating the first exemplary embodiment in detail.

FIG. 2 illustrates an intermediate transfer belt 9 (described below) and a roller 12 that supports the intermediate transfer belt 9 in detail. The image-forming apparatus according to this exemplary embodiment will now be described with reference to FIGS. 1 and 2.

A photosensitive drum (image carrier) 1 rotates in the direction of an arrow A shown in FIG. 1, and the surface thereof is negatively charged in a uniform manner by an electrifying unit 2 during the rotation of the photosensitive drum 1. The charged photosensitive drum 1 is exposed to light by an exposing unit 3 that performs exposure on the basis of image information such that electrostatic images corresponding to the image information are formed.

A developing unit 8 including developing devices 4 to 7 corresponding to colors of yellow (Y), magenta (M), cyan (C), and black (BK), respectively, is disposed adjacent to the photosensitive drum 1. The electrostatic images formed on the photosensitive drum 1 are developed by any one of the developing devices 4 to 7 such that toner images are formed.

In this exemplary embodiment, the photosensitive drum 1 is negatively charged, and reversal development is performed on the photosensitive drum 1.

Therefore, the toner to be used is negatively charged.

The intermediate transfer belt 9, which serves as an image-carrying belt, is in contact with the surface of the photosensitive drum 1. The intermediate transfer belt 9 is supported by a plurality of rollers (supporting members) 10, 11, 50, 12, 13, and 14. The intermediate transfer belt 9 is rotated in the direction of an arrow B.

In this exemplary embodiment, the rollers 10 and 11 are metallic driven rollers drivingly connected to the intermediate transfer belt 9, and are disposed in the vicinity of a primary transfer position so as to form a flat primary transfer surface of the intermediate transfer belt 9. The roller 50 is a metallic driven roller disposed downstream of the roller 11. The roller 12 is a tension roller, which serves as a supporting member and a tensioner, for maintaining the tension of the intermediate transfer belt 9 to about 3.5 kgf. The tension roller 12 pushes the inner circumferential surface 92 of the intermediate transfer belt 9 by approximately 1.0 kgf using springs 52*a* and 52*b* via tension arms 51*a* and 51*b* so as to apply a constant tension to the intermediate transfer belt 9. At this time, the tension roller 12 is electrically grounded.

Here, the tension arms 51*a* and 51*b* and the springs 52*a* and 52*b* form a feature for moving the tension roller 12 in the directions of arrows C1 and C2 shown in FIG. 1.

The roller 14 is a driving roller for driving the intermediate transfer belt 9. The roller 13 is an inner secondary transfer roller for transferring the toner images on the intermediate transfer belt 9 to a recording material 20 by secondary transfer, and a bias (−1 to −3 kV) having the same polarity as that of the toner is applied to the roller 13 by a power supply HV2 for the secondary transfer. Also, a roller 16 serves as an outer secondary transfer roller, and is electrically grounded for transferring by secondary transfer. In this exemplary embodiment, the rollers 10, 11, 50, 12, and 14 are electrically grounded as shown in FIG. 1.

According to this exemplary embodiment, various materials may be used for the intermediate transfer belt 9. For example, the intermediate transfer belt 9 may be composed of resins such as polyimide, polycarbonate, polyester, polypropylene, polyethylene terephthalate, acryl, and vinyl chloride, or various rubbers. In this exemplary embodiment, the intermediate transfer belt 9 is composed of these materials containing a right amount of carbon black serving as an anti-static additive, and has a volume resistivity of about $10^8$ to $10^{13}$ Ω·cm and a thickness of about 0.07 to 0.5 mm.

Moreover, a primary transfer roller 15 is disposed on the back surface of the intermediate transfer belt 9 at the primary transfer position where the intermediate transfer belt 9 faces the photosensitive drum 1.

A primary transfer bias (+500 V to +1 kV) of positive polarity, which is opposite to that of the toner, is applied to the primary transfer roller 15 by a bias supply HV1 for the primary transfer, and thus the toner images on the photosensitive drum 1 are primarily transferred to the outer circumferential surface 91 of the intermediate transfer belt 9.

A drum cleaner 19 removes the toner that remains on the photosensitive drum 1 after the primary transfer.

Furthermore, a belt cleaner 21 for removing the toner that remains on the intermediate transfer belt 9 after the secondary transfer is disposed downstream of the secondary transfer position.

The outer secondary transfer roller 16 and the belt cleaner 21 can be brought into contact with and be separated from the intermediate transfer belt 9.

When color images having multiple colors are formed, the outer secondary transfer roller 16 and the belt cleaner 21 are separated from the intermediate transfer belt 9 (at a position shown by dashed lines in FIG. 1) until the toner images having the second-to-last color pass through the outer secondary transfer roller 16 and the belt cleaner 21. Moreover, in this exemplary embodiment, the recording material 20 is temporarily stopped by registration rollers 17, and then fed to the secondary transfer position with a predetermined timing. Subsequently, unfixed toner images are formed on the recording material 20 by the inner secondary transfer roller 13 and the outer secondary transfer roller 16.

The recording material 20 is fed to a fixing unit (not shown) by feeding members (not shown) after the secondary transfer such that the toner images are fused into the recording material 20.

A potential-controlling plate (electrode member) 54 covers the surface of the intermediate transfer belt 9 extending from the roller 11 disposed downstream of the primary transfer roller 15 to the roller 50 disposed downstream of the roller 11.

The potential-controlling plate 54 is fixed to the apparatus so as to be parallel to and separated from the surface of the intermediate transfer belt 9 at a predetermined distance (2 to 5 mm). Moreover, the potential-controlling plate 54 is electrically grounded. Downstream of the potential-controlling plate 54, another potential-controlling plate (electrode member) 53 is disposed so as to cover the surface of the intermediate transfer belt 9 extending from the roller 50 to the tension roller 12. The potential-controlling plate 53 is rotatably connected to shaft ends 50*a* and 50*b* of the roller 50 at circular holes of side portions 53*a* and 53*b* of the potential-controlling plate 53 via bearings 56*a* and 56*b*. Moreover, the potential-controlling plate 53 is movably connected to shaft ends 12*a* and 12*b* of the tension roller 12 at a U-shaped portion via bearings 57*a* and 57*b*. Furthermore, the potential-controlling plate 53 is electrically grounded.

The length of the intermediate transfer belt 9 may vary according to processing, temperature, humidity, and endurance. With the above-described structure, the potential-controlling plate 53 is disposed so as to be parallel to and separated from the moving surface of the intermediate transfer belt 9 at a predetermined distance (2 to 5 mm) at all times.

That is, the surface of the intermediate transfer belt 9 is moved as the tension roller 12 is moved. Also, the potential-controlling plate 53 is moved as the tension roller 12 is moved. At this time, the potential-controlling plate 53 is moved while maintaining the predetermined distance (2 to 5 mm) from the surface of the intermediate transfer belt 9. With this, the positional relationship between the intermediate transfer belt 9 and the potential-controlling plate 53 is maintained even when the tension roller 12 is moved, and thus toner scattering can be regulated.

At this time, the potential-controlling plate 53 is rotated and moved. The rotation center of the potential-controlling plate 53 corresponds to a rotation center 501 of the roller 50 adjacent to the tension roller 12.

The potential-controlling plate 53 can be formed of a metallic plate such as an SUS sheet having an elasticity. As described above, the length of the intermediate transfer belt 9 varies according to processing, temperature, humidity, endurance, and the like. Moreover, the length may vary in one belt. That is, the perimeter of the intermediate transfer belt 9 may vary at either end thereof. Therefore, the potential-controlling plate 53 composed of an elastic material can be always maintained parallel to the surface of the intermediate transfer belt 9 by the torsion of the potential-controlling plate 53 even when the perimeter of the intermediate transfer belt 9 differs at either end thereof. Herein, the bearings 56*a*, 56*b*, 57*a*, and 57*b* are electrically conductive, and the potentials of the bearings are the same as those of the roller 50 and the tension roller 12, i.e., grounded.

Next, image-forming processing of the image-forming apparatus according to this exemplary embodiment will be described.

First, electrostatic images are formed on the photosensitive drum 1. The electrostatic images are developed by the corresponding developing devices 4-7.

That is, when the electrostatic images formed on the photosensitive drum 1 correspond to image information of yellow, the electrostatic images are developed by the developing device 4 containing yellow toner. Thus, toner images of yellow are formed on the photosensitive drum 1. Subsequently, the toner images formed on the photosensitive drum 1 are transferred from the photosensitive drum 1 to the surface of the intermediate transfer belt 9 at a primary transfer position T1 where the intermediate transfer belt 9 is in contact with the photosensitive drum 1. On the other hand, toner that remains on the photosensitive drum 1 after the primary transfer is removed by the drum cleaner 19.

At this time, when images of a single color are to be formed, the toner images primarily transferred to the intermediate transfer belt 9 are immediately transferred by secondary transfer to the recording material 20. In contrast, when color images formed by superposing toner images of multiple colors are to be formed, the step of forming the toner images on the photosensitive drum 1 and the step of primary transfer of the toner images are repeated a number of times equal to the number of colors.

For example, when full-color images formed by superposing toner images of four colors are to be formed, toner images of yellow, magenta, cyan, and black are formed on the photosensitive drum 1 every rotation of the photosensitive drum 1. Then, these toner images are successively transferred by primary transfer to the intermediate transfer belt 9. On the other hand, the intermediate transfer belt 9 is rotated in the same cycle as the photosensitive drum 1 while carrying the first toner images that were primarily transferred, and the toner images of magenta, cyan, and black are transferred to the intermediate transfer belt 9 every rotation of the photosensitive drum 1.

In this manner, the toner images that are primarily transferred to the intermediate transfer belt 9 are carried to a secondary transfer position T2 as the intermediate transfer belt 9 is rotated. On the other hand, the recording material 20 is fed to the secondary transfer position T2 by the registration rollers 17 with a predetermined timing.

The recording material 20 is nipped between the intermediate transfer belt 9 and the outer secondary transfer roller 16 that is grounded with respect to the inner secondary transfer roller 13, a secondary transfer bias having the same polarity as the toner being applied to the inner secondary transfer roller 13.

That is, the toner images on the intermediate transfer belt 9 are electrostatically transferred to the recording material 20 at the secondary transfer position T2 by passing the recording material 20 through a transfer electric field formed between the inner secondary transfer roller 13 and the outer secondary transfer roller 16 with a predetermined timing.

On the other hand, the image-carrying surface of the intermediate transfer belt 9 that passes through the secondary transfer position is cleaned by the belt cleaner 21.

In the first exemplary embodiment, the surface of the intermediate transfer belt 9 is covered with the potential-controlling plate 54 in the area where the intermediate transfer belt 9 is extending from the roller 11 disposed downstream of the primary transfer roller 15 to the roller 50 disposed downstream of the roller 11 as described above. Moreover, the potential-controlling plate 53 that covers the belt surface extending from the roller 50 to the tension roller 12 is disposed so as to be parallel to and separated from the belt surface at a predetermined distance, thereby controlling the potential of the intermediate transfer belt 9.

The mechanism of toner scattering that occurs on the intermediate transfer belt 9 and the effect of the potential-controlling plates 53 and 54 will now be described.

The mechanism of toner scattering can be considered as follows.

Figure 3:
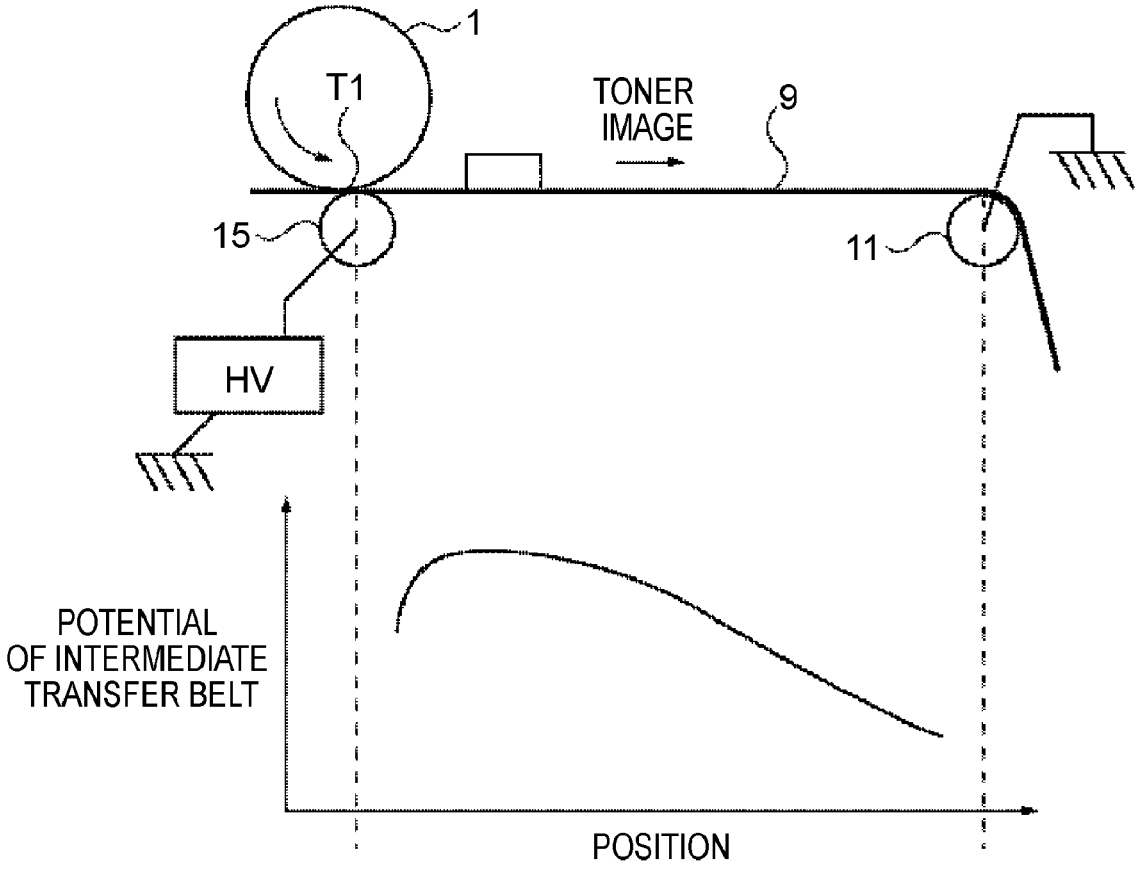
FIG. 3 is a graph illustrating the mechanism of occurrence of toner scattering.

As shown in FIG. 3, the potential of the intermediate transfer belt 9 increases when the intermediate transfer belt 9 passes through the primary transfer position T1 where the intermediate transfer belt 9 is nipped between the photosensitive drum 1 and the primary transfer roller 15 to which a positive bias having a polarity opposite to the toner, for example, is applied, and then attenuated while the intermediate transfer belt 9 reaches the roller 11.

Figure 4A:
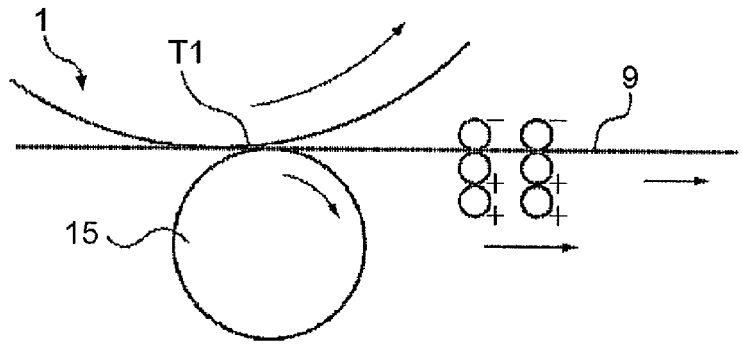
FIG. 4A is a schematic drawing and FIG. 4B is another graph illustrating the mechanism of occurrence of toner scattering.

As shown in FIG. 4A, the number of positive charges retained on the intermediate transfer belt 9 is larger than that of negative charges (the extra positive charges are referred to as surplus charges) immediately after the intermediate transfer belt 9 passes through the primary transfer position T1, and the intermediate transfer belt 9 is apparently positively charged.

The potential of the intermediate transfer belt 9 is raised since the surplus charges are carried by the intermediate transfer belt 9 to a position remote from the primary transfer roller 15.

Figure 4B:
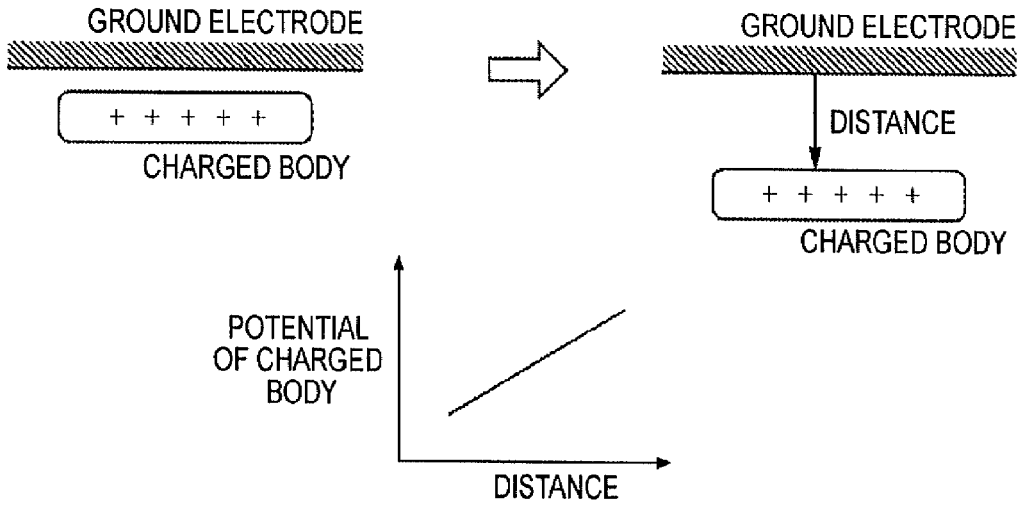

This can be explained by a phenomenon that the potential of a charged body is raised as the charged body is separated from a ground electrode as shown in FIG. 4B.

That is, the capacitance of a capacitor (air space) becomes small as the distance between the charged body and the ground electrode is increased, and thus the potential difference from a reference potential (the potential of the charged body) is increased.

This is the reason why the potential of the intermediate transfer belt 9 is raised at first.

However, after the rise in the potential, the potential of the intermediate transfer belt 9 is attenuated while the intermediate transfer belt 9 is moved toward the roller 11 as shown in FIG. 3.

This is because the number of surplus charges retained on the intermediate transfer belt 9 is reduced while the intermediate transfer belt is conveyed.

Figure 5A:
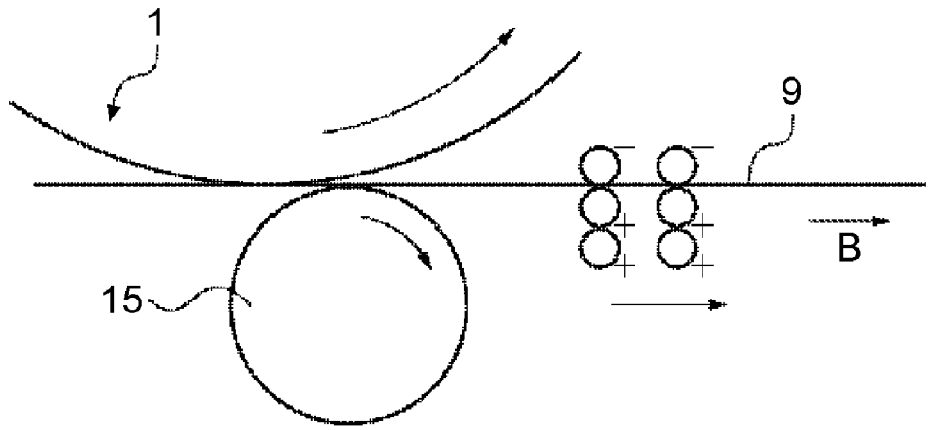
FIG. 5A is a schematic drawing and FIG. 5B is yet another graph illustrating the mechanism of occurrence of toner scattering.
Figure 5B:
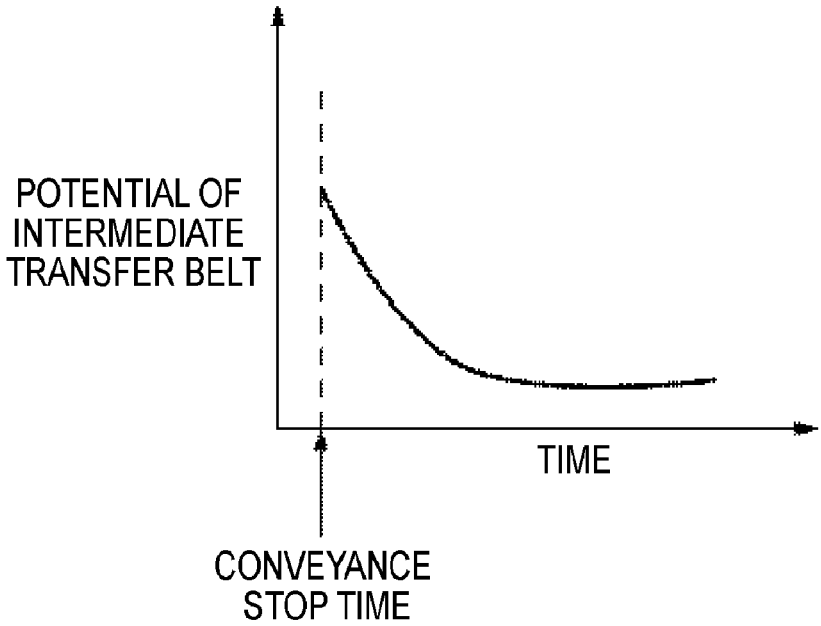

For example, when the conveyance of the intermediate transfer belt 9 having the surplus charges as shown in FIG. 5A is suspended, the potential of the intermediate transfer belt 9 at the portion is attenuated over time as shown in FIG. 5B.

The potential of the intermediate transfer belt 9 is attenuated even when the distance from the surface of the primary transfer roller 15 is not changed since the number of surplus charges retained on the intermediate transfer belt 9 is reduced over time.

This is the main reason why the potential of the intermediate transfer belt 9 is attenuated after the potential rise until the intermediate transfer belt 9 is moved toward the roller 11.

Under this condition, when the distance between the primary transfer roller 15 and the roller 11 is short or the moving speed of the intermediate transfer belt 9 is high, the intermediate transfer belt 9 approaches the grounded roller 11 while the potential of the intermediate transfer belt 9 is maintained at a high level.

At this time, when the potential difference between the intermediate transfer belt 9 and the roller 11 is large, the electric field intensity in the vicinity of the roller 11 becomes high, and the intermediate transfer belt 9 discharges electricity. With this, charges having a polarity opposite to that of the toner and binding the charged toner images are excessively removed from the intermediate transfer belt 9. Thus, the binding force that binds the toner is lost, and toner scattering occurs.

The above is the reason for toner scattering.

The potential-controlling plates 53 and 54 provided at the above-described positions function as references of the potential of the intermediate transfer belt 9, and thus the potential of the intermediate transfer belt 9 can be controlled.

Experimental results that are obtained when the potential-controlling plates 53 and 54 according to the present invention are used on the basis of the mechanism of occurrence of toner scattering and the effect of the potential-controlling plates 53 and 54 described above will now be described with reference to FIGS. 6 and 7.

In this exemplary embodiment, the radii of the photosensitive drum 1, the roller 11, and the roller 50 are set to about 42, 10, and 17 mm, respectively, and the distances between the potential-controlling plates 53 and 54 and the intermediate transfer belt 9 are set from 2 to 4 mm. The primary transfer roller 15 has an external diameter of about 16 mm, and an Asker C hardness (at a load of 500 gf) of 40±5°.

Figure 6:
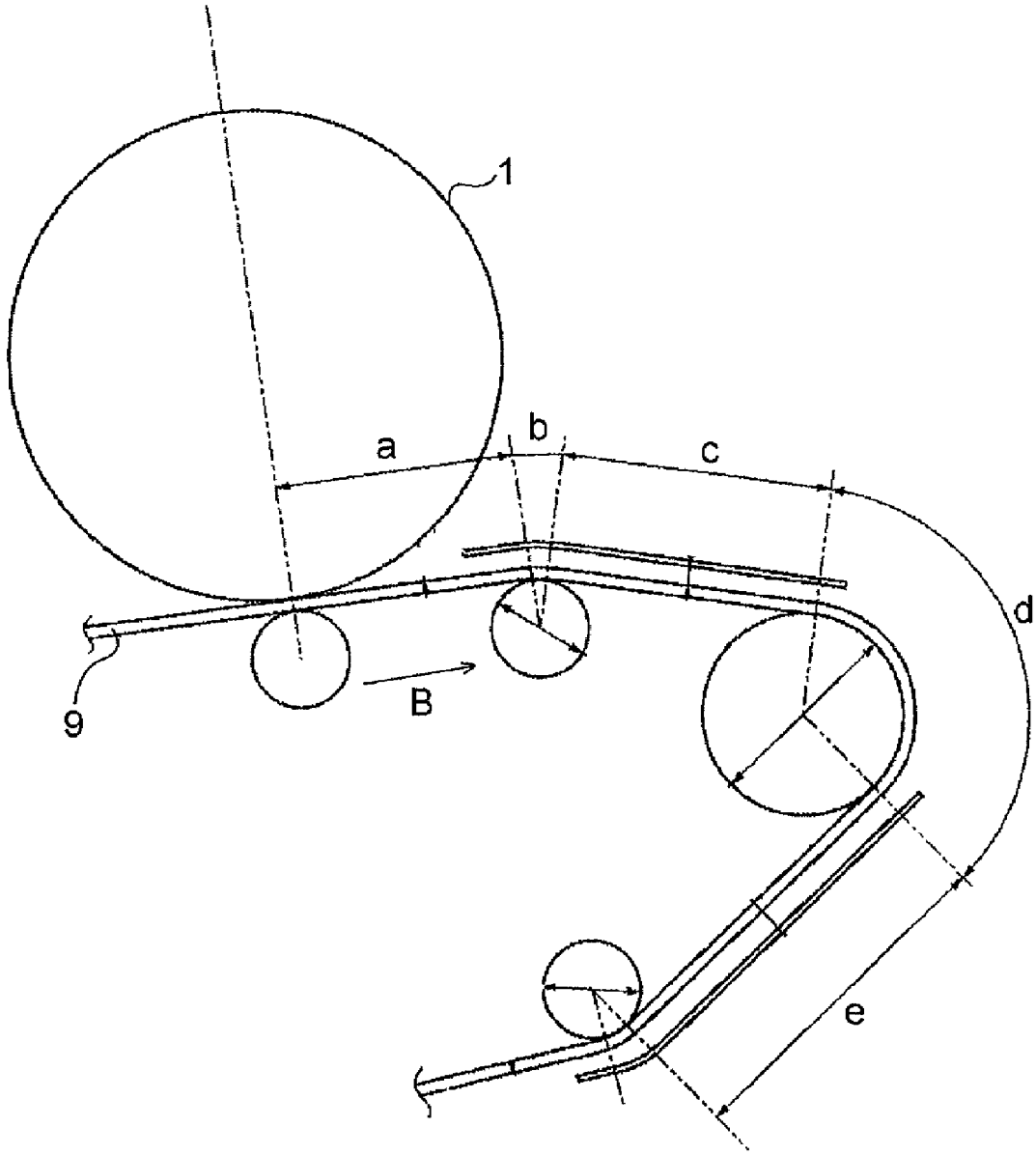
FIG. 6 is a schematic drawing illustrating the effect of potential-controlling plates.
Figure 7:
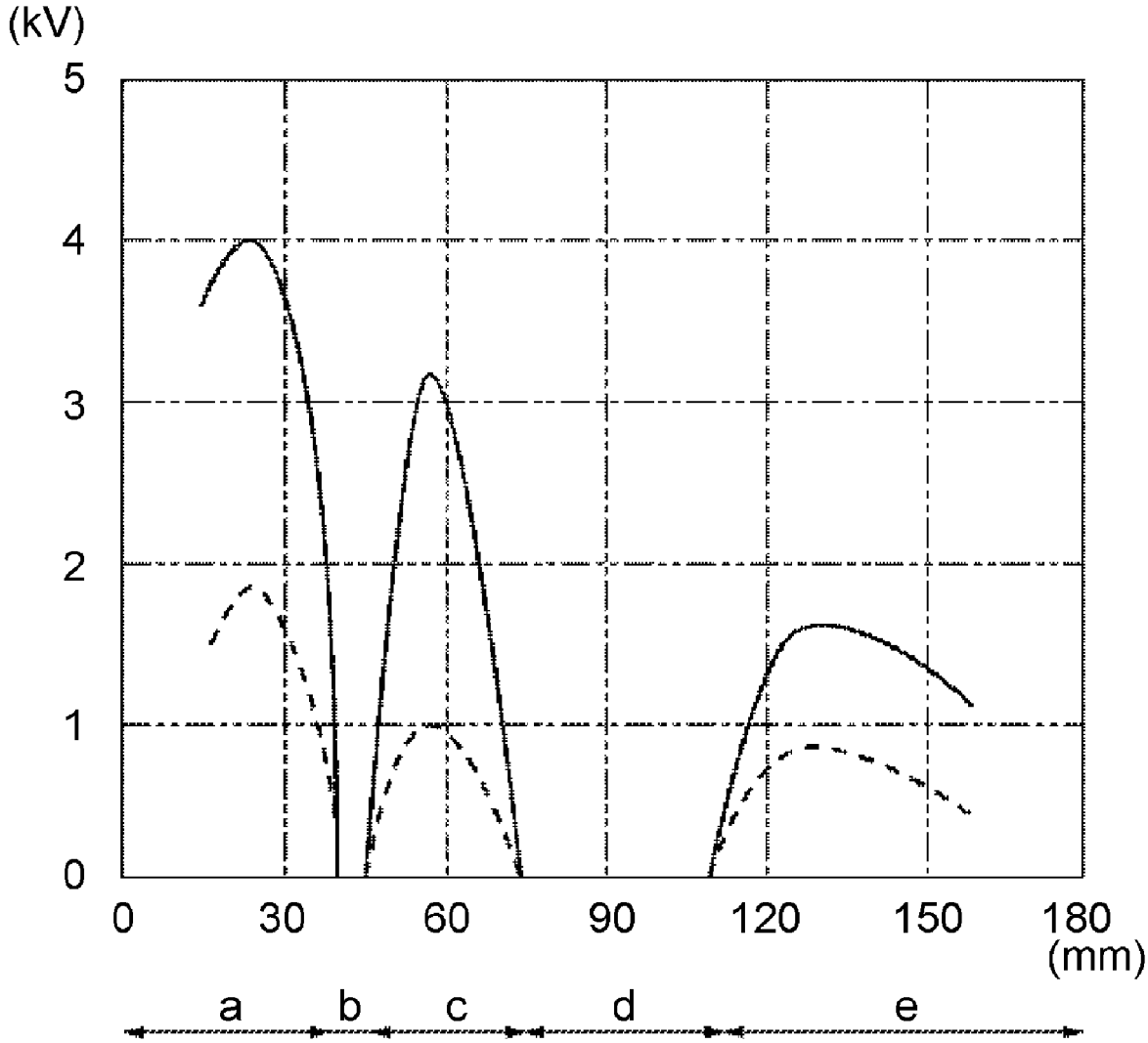
FIG. 7 is another graph illustrating the effect of the potential-controlling plates.

FIG. 7 illustrates the potential of the intermediate transfer belt 9 at positions a to e shown in FIG. 6. When the potential-controlling plates 53 and 54 are disposed as described above, the potential of the intermediate transfer belt 9 can be controlled (indicated by dashed lines) compared with the case without the potential-controlling plates 53 and 54 (indicated by solid lines).

That is, the potential difference between the intermediate transfer belt 9 and the rollers 11, 50, and 12 are reduced, and the electric field intensity in the vicinity of the contact portions of the intermediate transfer belt 9 and the rollers 11, 50, and 12 is reduced. Therefore, the electric discharge is regulated, and the charges having a polarity opposite to that of the toner and binding the charged toner images are not excessively removed from the intermediate transfer belt 9. Thus, the binding force that binds the toner to the intermediate transfer belt 9 is not lost, and toner scattering does not occur. According to the present invention, the tension roller 12 is moved in the directions of the arrows C1 and C2. However, the tension roller 12 may be moved only in the direction of the arrow C1 or in the direction of the arrow C2.

Second Exemplary Embodiment

The rollers 11, 50, and 12 shown in FIG. 1 are grounded. In contrast, a bias (+1 to +3 kV) having a polarity opposite to that of the toner is applied to the rollers 11, 50, and 12 of the image-forming apparatus according to this exemplary embodiment shown in FIG. 8 by a power supply HV3.

When a bias is applied to the roller 11, the potential of the intermediate transfer belt 9 is also raised. However, the potential difference between the roller 11 and the intermediate transfer belt 9 can be further reduced due to the potential-controlling plate 54.

Thus, the electric field intensity in the vicinity of the contact portion of the intermediate transfer belt 9 and the roller 11 can also be further reduced, and toner scattering can be effectively prevented.

Figure 8:
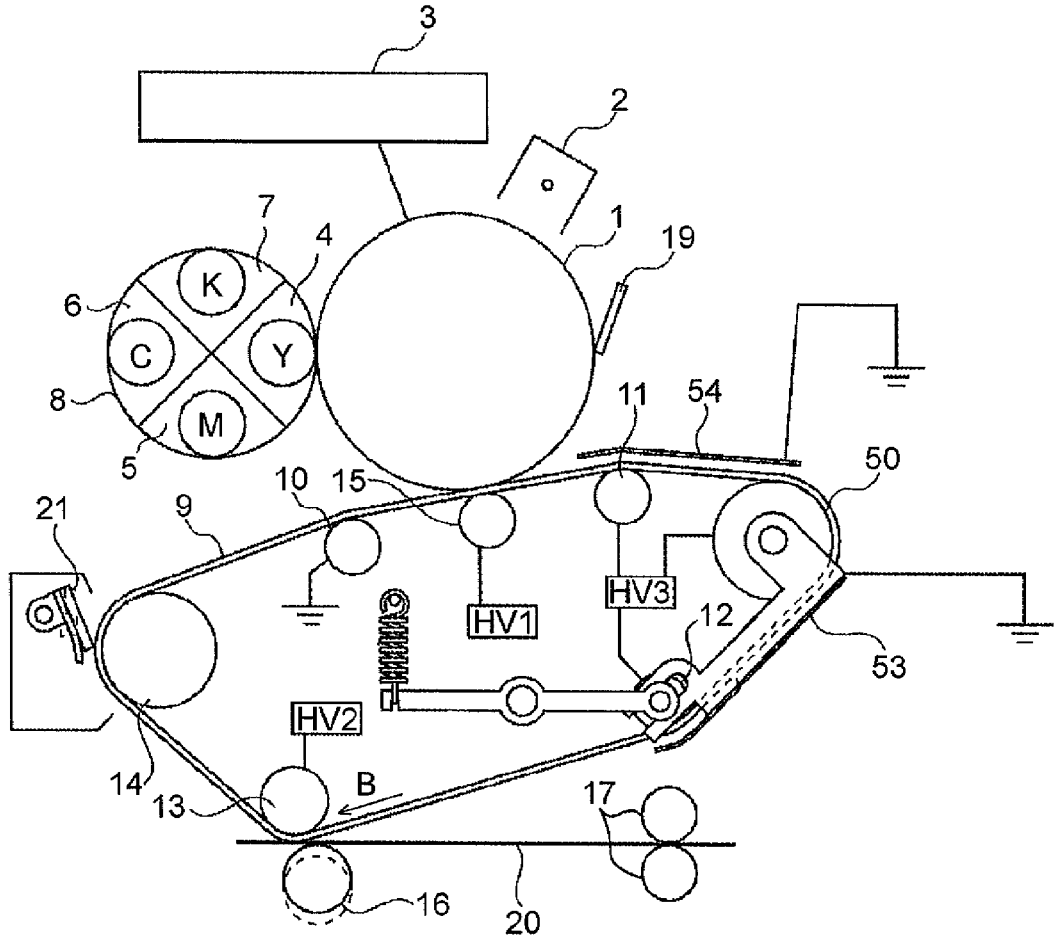
FIG. 8 illustrates a second exemplary embodiment.
Figure 9:
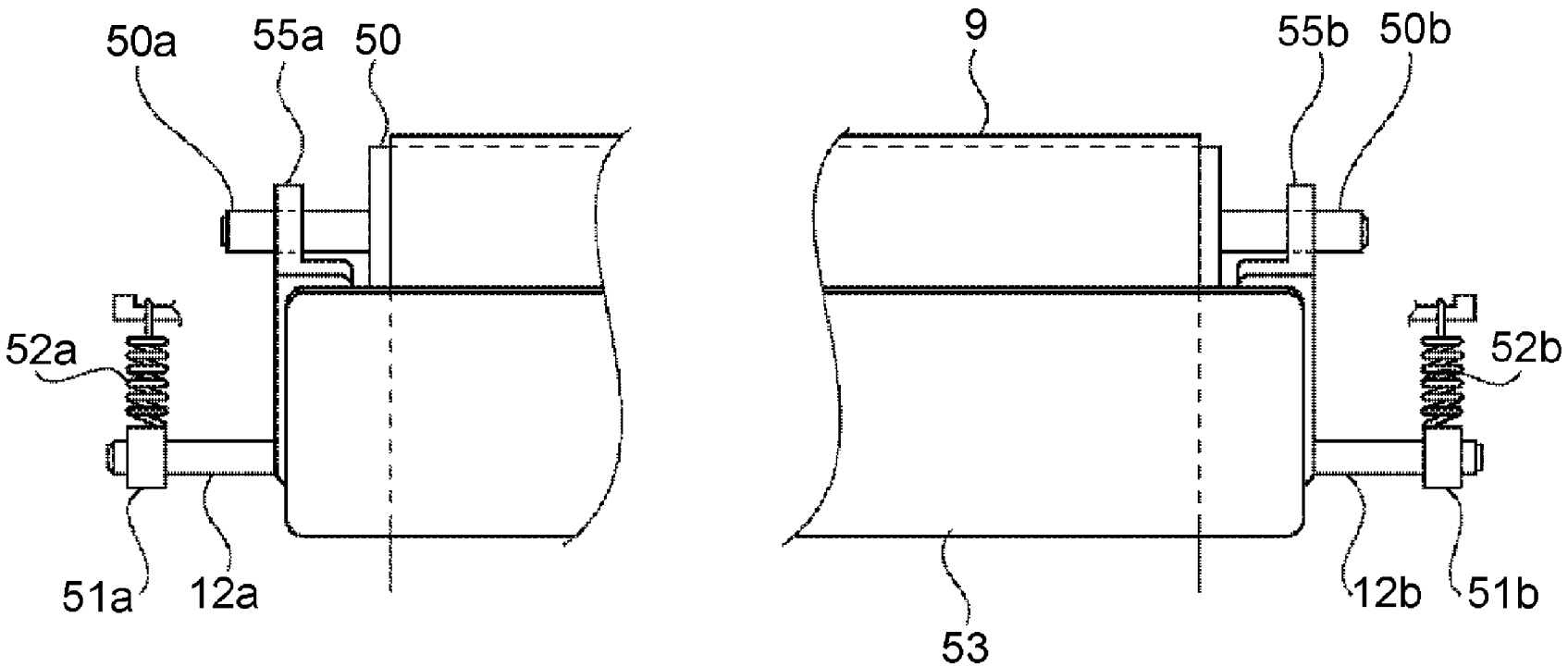
FIG. 9 illustrates the second exemplary embodiment in detail.

Therefore, as shown in FIGS. 8 and 9, the potential-controlling plate 53 according to the second exemplary embodiment of the present invention is attached to the apparatus via insulating members 55*a* and 55*b*.

The insulating member 55*a* is rotatably connected to the shaft end 50*a* of the roller 50 at a circular hole formed in one end of the insulating member 55*a*, and is also movably connected to the shaft end 12*a* of the tension roller 12 at a U-shaped portion of the insulating member 55*a*.

Similarly, the insulating member 55*b* is rotatably connected to the shaft end 50*b* of the roller 50 at a circular hole formed in one end of the insulating member 55*b*, and is also movably connected to the shaft end 12*b* of the tension roller 12 at a U-shaped portion of the insulating member 55*b*.

The potential-controlling plate 53 is connected to these insulating members 55*a* and 55*b*, and is disposed so as to be parallel to and separated from the moving surface of the intermediate transfer belt 9 at a predetermined distance at all times as in the first exemplary embodiment.

Moreover, the potential-controlling plate 53 is formed of a metallic plate such as an SUS sheet having an elasticity as in the first exemplary embodiment, and thus can be always maintained parallel to the surface of the intermediate transfer belt 9 by the torsion of the potential-controlling plate 53 even when the perimeter of the intermediate transfer belt 9 differs at either end thereof.

In the second exemplary embodiment, the potential-controlling plate 53 is grounded as shown in FIG. 8.

Thus, the potential of the intermediate transfer belt 9 can be controlled as in the first exemplary embodiment. Therefore, the potential difference between the intermediate transfer belt 9 and the rollers 11, 50, and 12 are reduced, and the electric field intensity in the vicinity of the contact portions of the intermediate transfer belt 9 and the rollers 11, 50, and 12 is reduced. Therefore, the electric discharge is regulated, and the charges having a polarity opposite to that of the toner and binding the charged toner images are not excessively removed from the intermediate transfer belt 9. Thus, the binding force that binds the toner to the intermediate transfer belt 9 is not lost, and toner scattering does not occur.

The potentials of the rollers 11, 50, and 12 and the potential-controlling plates 53 and 54 are not limited to those shown in FIGS. 1 and 8.

Figure 10:
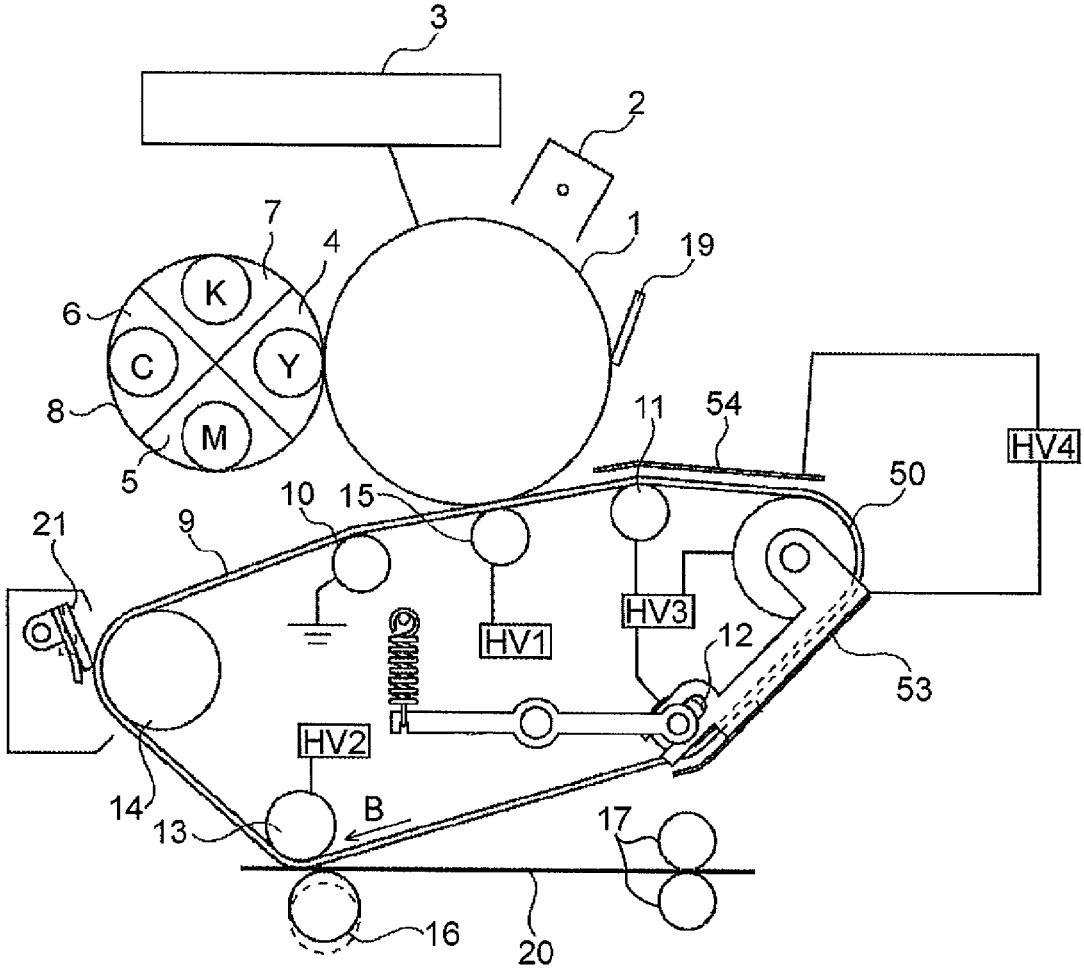
FIG. 10 illustrates another exemplary embodiment.

That is, as shown in FIG. 10, the bias of +1 to +3 kV may be applied to the rollers 11, 50, and 12 by the power supply HV3. Moreover, a bias of +1 to +3 kV may also be applied to the potential-controlling plates 53 and 54 by a power supply HV4.

Figure 11:
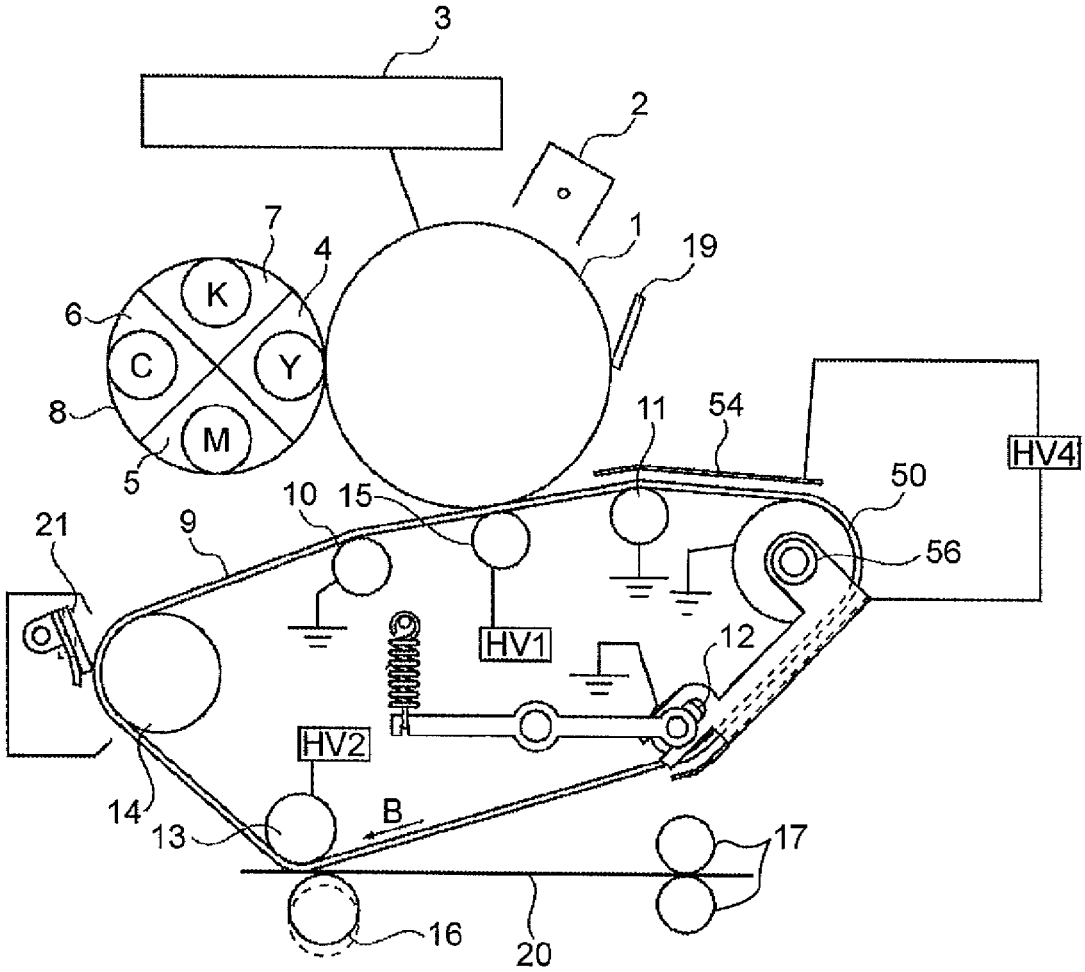
FIG. 11 illustrates yet another exemplary embodiment.

Furthermore, as shown in FIG. 11, the rollers 11, 50, and 12 may be grounded, and a bias of +1 to +3 kV may be applied to the potential-controlling plates 53 and 54 by the power supply HV4.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Application No. 2005-265525 filed Sep. 13, 2005, which is hereby incorporated by reference herein in its entirety.

What is claimed is:

1. An image-forming apparatus comprising:

an image-carrying belt that is rotated while carrying toner images on an outer circumferential surface thereof;

a movable tensioner applying tension to the image-carrying belt, a position of the tensioner being changed while being in contact with the inner circumferential surface of the image-carrying belt, the tensioner being electrically grounded or a voltage being applied to the tensioner; and an electrode member, a position of the electrode member being changed in conjunction with a change of the position of the tensioner so as to maintain a predetermined distance from the image-carrying belt, the electrode member being electrically grounded or a voltage being applied to the electrode member.

2. The image-forming apparatus according to claim 1, wherein a unit for moving the tensioner also moves the electrode member.

3. An image-forming apparatus comprising:

an image-carrying belt that is rotated while carrying toner images on an outer circumferential surface thereof;

a movable tensioner applying tension to the image-carrying belt, a position of the tensioner being changed while being in contact with the inner circumferential surface of the image-carrying belt, the tensioner being electrically grounded or a voltage being applied to the tensioner;

a movable electrode member, the electrode member being electrically grounded or a voltage being applied to the electrode member; and a connecting member connecting the tensioner and the electrode member, and wherein the electrode member is moved in conjunction with movement of the tensioner by the connecting member.

* * * * *